US008833270B2

(12) United States Patent
Jian

(10) Patent No.: US 8,833,270 B2
(45) Date of Patent: Sep. 16, 2014

(54) PLASTIC PALLET STRUCTURE

(71) Applicant: Camry Packing Industrial Limited, New Taipei (TW)

(72) Inventor: Bo-Xin Jian, New Taipei (TW)

(73) Assignee: Camry Packing Industrial Limited, New Taipei (TW)

( * ) Notice: Subject to any disclaimer, the term of this patent is extended or adjusted under 35 U.S.C. 154(b) by 0 days.

(21) Appl. No.: 13/903,792

(22) Filed: May 28, 2013

(65) Prior Publication Data

US 2013/0247798 A1 Sep. 26, 2013

Related U.S. Application Data

(63) Continuation of application No. 13/211,488, filed on Aug. 17, 2011, now Pat. No. 8,448,582.

(30) Foreign Application Priority Data

May 23, 2011 (TW) ..... 100118022 A

(51) Int. Cl.
*B65D 19/16* (2006.01)
*B65D 19/00* (2006.01)

(52) U.S. Cl.
CPC .. *B65D 19/0097* (2013.01); *B65D 2519/00069* (2013.01); *B65D 2519/00308* (2013.01); *B65D 2519/00034* (2013.01); *B65D 2519/00273* (2013.01); *B65D 2519/00402* (2013.01); *B65D 2519/00338* (2013.01); *B65D 2519/00432* (2013.01); *B65D 2519/00323* (2013.01); *B65D 2519/0099* (2013.01); *B65D 2519/00567* (2013.01); *B65D 2519/00129* (2013.01); *B65D 2519/00293* (2013.01); *Y10S 108/901* (2013.01)
USPC ..... 108/56.3; 108/901

(58) Field of Classification Search
CPC ..... B65D 2519/00323; B65D 2519/00333; B65D 2519/00034; B65D 2519/00069; B65D 2519/00104; B65D 2519/00273; B65D 2519/00293; B65D 2519/00378; B65D 2519/00567
USPC ..... 108/53.1, 56.1, 56.3, 901–902
See application file for complete search history.

(56) References Cited

U.S. PATENT DOCUMENTS 3,469,542 A 9/1969 Ahlenius
3,875,280 A * 4/1975 Story ..... 264/510

(Continued)

FOREIGN PATENT DOCUMENTS

GB 2272203 A 5/1994
KR 100396194 B1 8/2003

(Continued)

*Primary Examiner* — Hanh V Tran
(74) *Attorney, Agent, or Firm* — Rabin & Berdo, P.C.

(57) ABSTRACT

The plastic pallet structure includes a supporting base and loading plates. The supporting base includes first bases and second bases. Each first base includes a first base body, first opening clamping portions and first arch bridge portions. The first opening clamping portions and the first arch bridge portions are respectively disposed on two first long side edges of the first base body. Each second base includes a second base body, second opening clamping portions and second arch bridge portions. The second opening clamping portions and the second arch bridge portions are disposed on a second long side edge of the second base body. When the loading plates load goods, forks of a forklift are inserted in to the second bases, so that the forks of the forklift are abutted against the second arch bridge portions without contacting with the loading plates to lift the goods up.

11 Claims, 6 Drawing Sheets

(56) References Cited

U.S. PATENT DOCUMENTS

| | | | | |
|---|---|---|---|---|
| 4,230,050 | A * | 10/1980 | Mays | 108/57.17 |
| 4,359,948 | A | 11/1982 | Judy et al. | |
| 4,735,154 | A | 4/1988 | Hemery | |
| 4,869,179 | A | 9/1989 | Sammons et al. | |
| 5,357,875 | A | 10/1994 | Winebarger et al. | |
| 5,417,167 | A | 5/1995 | Sadr | |
| 5,487,345 | A | 1/1996 | Winebarger et al. | |
| 5,950,546 | A | 9/1999 | Brown et al. | |
| 6,155,181 | A | 12/2000 | Chilcutt | |
| 6,837,170 | B2 | 1/2005 | Taft | |
| 6,892,651 | B1 | 5/2005 | Van Reed et al. | |
| 6,997,112 | B2 * | 2/2006 | Nishizaki et al. | 108/51.3 |
| 8,113,129 | B1 | 2/2012 | Hurley et al. | |
| 8,448,582 | B2 * | 5/2013 | Jian | 108/56.3 |
| 2003/0005862 | A1 | 1/2003 | Halavais | |
| 2004/0226490 | A1 | 11/2004 | Polumbaum | |
| 2008/0066657 | A1 | 3/2008 | Kuo | |
| 2009/0090280 | A1 * | 4/2009 | Mills | 108/53.1 |
| 2012/0204767 | A1 * | 8/2012 | Jian et al. | 108/51.3 |

FOREIGN PATENT DOCUMENTS

| | | | |
|---|---|---|---|
| KR | 200400826 | Y1 | 11/2005 |
| KR | 100842801 | B1 | 7/2008 |

* cited by examiner

PLASTIC PALLET STRUCTURE

CROSS-REFERENCES TO RELATED APPLICATIONS

This application is a continuation application of U.S. application Ser. No. 13/211,488 filed in United States on Aug. 17, 2011, which itself claims priority under 35 U.S.C. §119(a) of Patent Application No. 100118022 filed in Taiwan, R.O.C. on May 23, 2011, the entire contents of which are hereby incorporated by reference.

TECHNICAL FIELD

The present invention relates to a pallet structure, and more particularly to a partly replaceable plastic pallet structure, which can carry a light or heavy weight

BACKGROUND

Pallets are very common auxiliary tool in cargo transportation. A conventional pallet is a base similar to a platform, formed by nailing a plurality of interlaced wood strips or boards together; the top thereof is a mounting face for the placement of goods, and there are foot pieces below the mounting face to elevate the mounting face to allow goods placed on the mounting face to be kept off the ground, preventing the goods, which are otherwise too close to the ground, from being made wet, or being contaminated by pollutants on the ground.

The great majority of pallets available in the market currently are wood, paper, plastic and ferrous alloy pallets. The wood pallet is most widely used of these, but because the whole structure thereof is assembled from wood, a large amount of wood must be cut down before a certain amount of wood pallets can then be made; this is not congruent with environmental protection aims. Furthermore, the entirety of the wood pallet is fixed, so the whole wood pallet must be discarded as junk if even one part is damaged. In addition, the size of an assembled wood pallet is fixed; it cannot be folded for storage, and uses space inefficiently.

Similarly, since a pallet such as a paper, plastic or iron alloy pallet is limited by the weight it can bear that the other, the entire must be discarded as junk if the goods it carries are overweight, causing damage to even one part of the pallet; this is a waste of natural resources.

SUMMARY

To improve a pallet structure, increase usage convenience, and obtain a good bearing capacity, the present invention is proposed.

The present invention proposes a plastic pallet structure that can carry light or heavy weight goods and is partly replaceable, including a plurality of horizontal and vertical bases; each horizontal base includes a basic portion, including a plurality of opening retaining portions, extension portions, arch bridge portions and first and second supporting portions, where a three-dimensional mesh supporting structure is used to couple to each portion to form a three-dimensional base. Each vertical base is formed by means of plastic extrusion, including a basic portion, where the basic portion includes a plurality of opening clamping portions, extension portions, arch bridge portions, first and second supporting portions, where a three-dimensional mesh supporting structure is used to couple to each portion to form a three-dimensional base.

The plurality of horizontal bases and vertical bases are respectively cross linked together in horizontal and vertical directions at each opening clamping portion by means of opening-to-opening to form a plastic pallet with the plurality of horizontal bases and vertical bases. The opening clamping portion is preset with a slide-in slot.; a cut line is reserved on the slide-in slot; a buckling element or tenon is preset along a joint of the cut line, allowing the two differently directional opening clamping portions to be slipped in each other along the slide-in slot, and locked by the buckling elements while two openings are respectively arrived at fixed positions, thereby bucking the horizontal and vertical bases to each other tightly. The slide-in slot has a certain elasticity due to the disposition of the cut line, allowing the buckling elements to be released easily while being separated, thereby forming a plastic pallet capable of being combined and detached.

The arch bridge in the present invention is a bow-typed body formed by contracting one basic portion gradually inward between the two adjacent extension portions, allowing the forks of a forklift to be inserted. Both the horizontal and vertical bases have arch bridge portions for the forks of a forklift to be inserted; it is convenient for the forks to be inserted into the pallet in every direction. Forces acted on the arch bridge portion can be uniform, due to the disposition of the extension portions, so the base is not easily fractured.

The present invention also proposes a mesh-typed structure body, which is a three-dimensional mesh-typed structure of sheet body group formed by molding a soft plastic material into a mechanical structure intersected by means of X, Y, E and trapezoid structures, which generates stresses and is formed solidly to couple to each section.

The present invention further proposes a plastic pallet structure for a heavy load, including a plurality of horizontal and vertical bases, each horizontal base includes a basic portion, including a plurality of opening clamping portions, extension portions, arch bridge portions, a first supporting portion and a second supporting portion; in addition, it also includes a beam column passed through the base and a three-dimensional mesh-typed supporting structure coupled to each section.

The present invention also includes a plurality of vertical base; each vertical base includes a basic portion, including a plurality of opening clamping portions, extension portions, arch bridge portions, a first supporting portion and a second supporting portion. In addition, it also includes a beam column passed through the base and a three-dimensional mesh-typed supporting structure coupled to each section, where the three-dimensional mesh-typed supporting structure is made by plastic extrusion, formed into a combined sheet body group by means of X, Y, E, and trapezoid structures and the like to couple the all sections together to form the base.

Furthermore, the horizontal base and the vertical bases are engaged with each other diagonally and vertically through the corresponding opening clamping portion opening-to-opening, thereby combing the plurality of horizontal and vertical bases to form a plastic pallet with bidirectional beam columns included of the plurality of bases.

If the material of the beam column is the same as the other parts, the beam column can be integrated with the base, extension portion, arch bridge portion by means of extrusion, allowing the three-dimensional mesh-typed supporting structure and the beam column to be bonded tightly into one body like the trunk and the branches of a tree. A material other than the material of other parts may also be used as the beam column, such as metal, the beam needed may be installed in the base afterwards as long as an accepting space is formed at beam column placing points of each base in advance; for example, a circular hole, which is parallel to the opening clamping portions and passed through the base is opened. Consequently, the plastic pallet having the overlapping beam columns and capable of bearing a heavy weight can be formed after having the opening clamping portion, the slide-in slot in the opening clamping portion, the buckling element in the slipping-slot, the extension portions and arch bridge portions of the base, the supporting formed by coupling the mesh-typed structure body to every section, and the combination of the plurality of bases.

The present invention can increase the bearing capacity of a plastic pallet, avoid structural fractures or damage to buckling elements, replace parts quickly when a part is damaged, avoid the waste of resources, and further conform to environmental protection aims; saving energy, and reduce waste.

BRIEF DESCRIPTION OF THE DRAWINGS

The present invention can be more fully understood by reference to the following description and accompanying drawings, in which.

DETAILED DESCRIPTION

Figure 1:
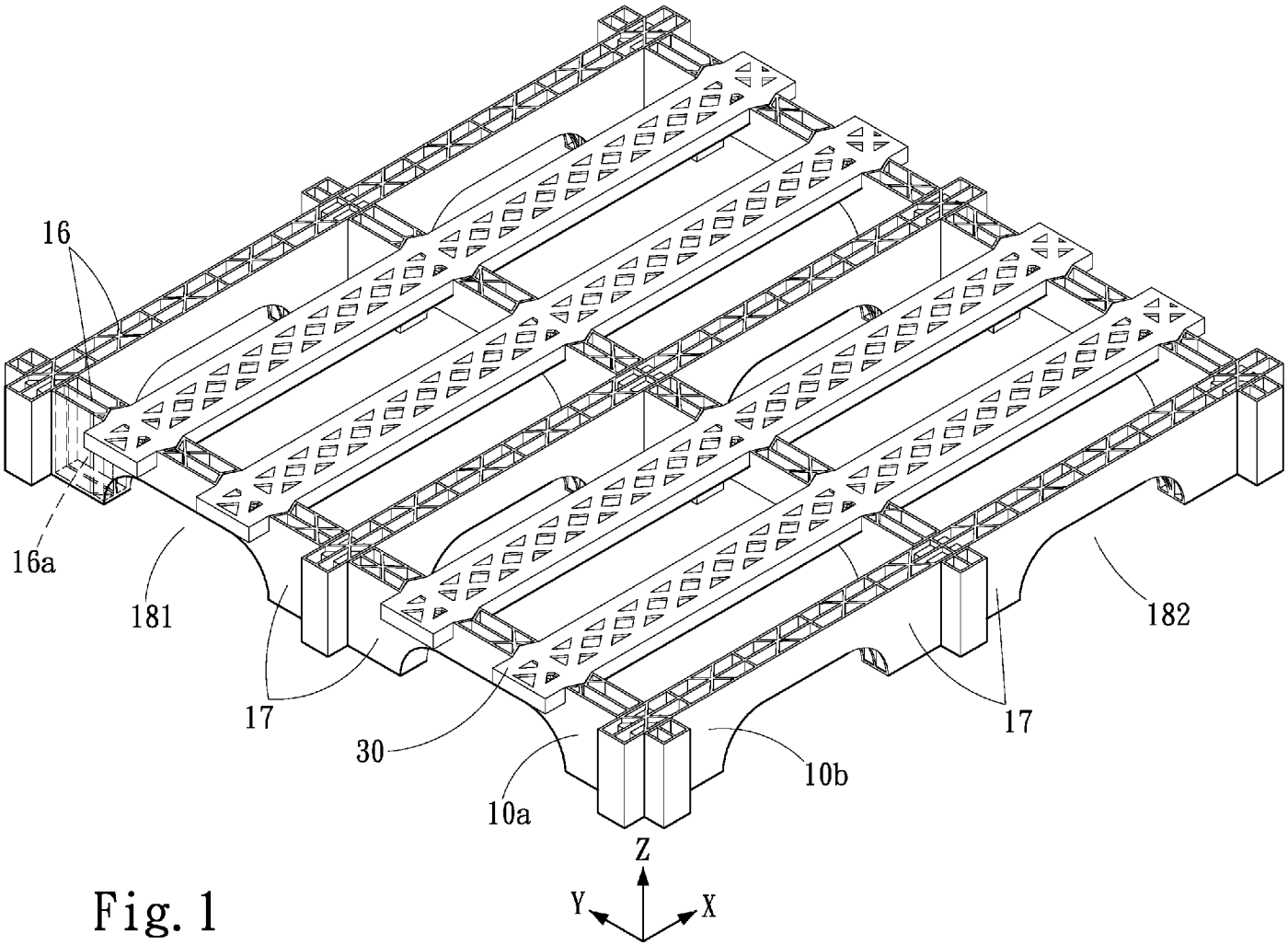
FIG. 1 is a perspective view of a plastic pallet of the present invention.
Figure 2:
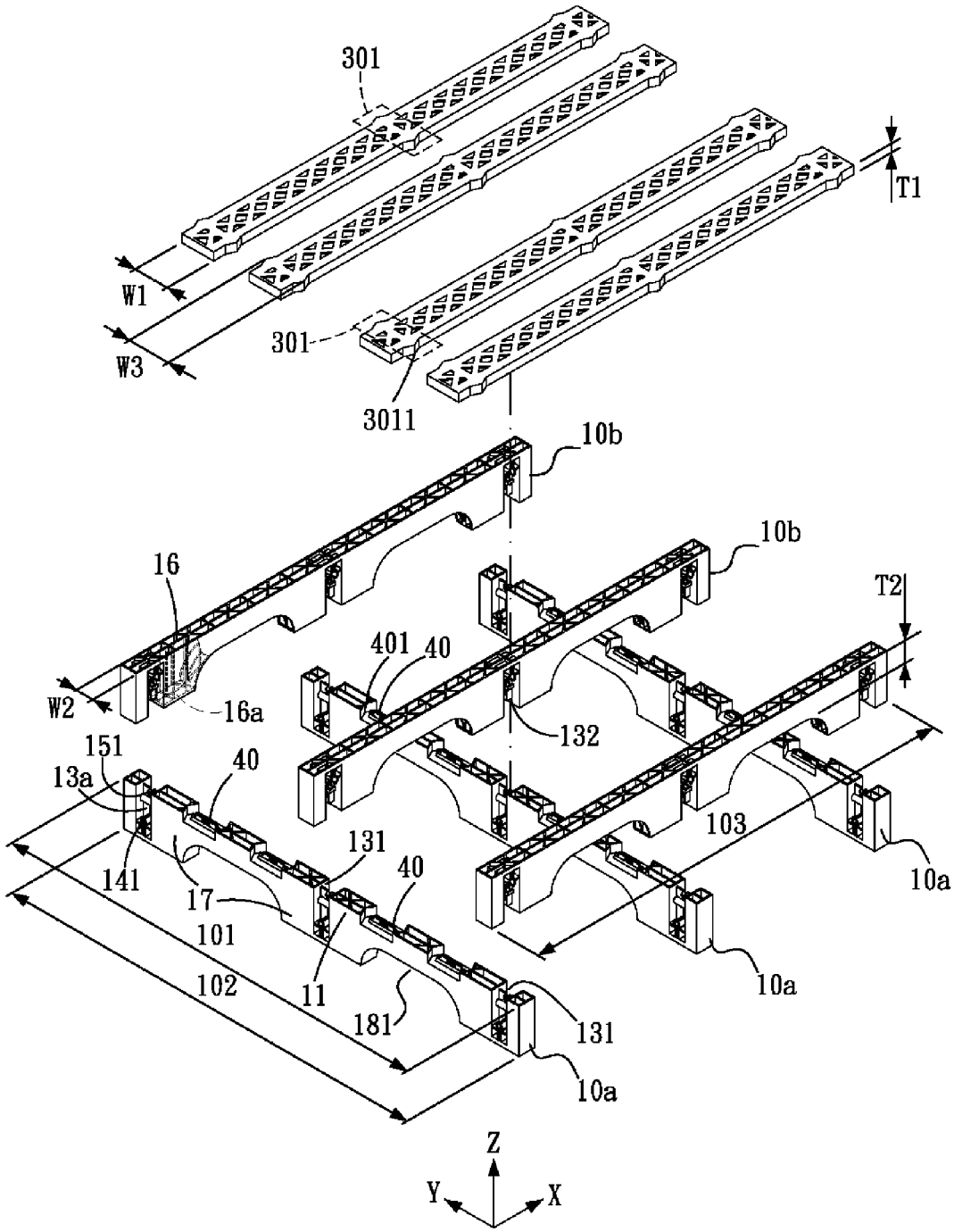
FIG. 2 is an exploded view of a plastic pallet of the present invention.

Please refer to FIGS. 1 and 2, in which a plastic pallet of a preferred embodiment according to the present invention is included of a plurality of bases coupled together by horizontal bases (hereafter called as first bases 10*a*) and vertical bases (hereafter called as second bases 10*b*) in a horizontal direction and a vertical direction, where each base (each first base 10*a* or each second base 10*b*) includes a basic portion 11, extension portions 17, arch bridge portions 18, a first supporting portion 16 and a second supporting portion 16*a*.

Please refer to FIG. 2, in which is shown an exploded view of a plastic pallet of the present invention.

The plastic pallet structure of the present invention includes a supporting base and a plurality of loading plates 30. The supporting base includes a plurality of first bases 10*a* and a plurality of second bases 10*b*. The first bases 10*a* are aligned along a first direction. Here, the first direction is the X-axis direction. Each first base 10*a* includes a first base body, a plurality of first opening clamping portions 131 and a plurality of first arch bridge portions 181. The first opening clamping portions 131 are disposed on a first long side edge 101 of the first base body. The first arch bridge portions 181 are disposed on another first long side edge 102 of the first base body and are spacingly aligned between the first opening clamping portions 131. The second bases 10*b* are aligned along a second direction. Here, the second direction is the Y-axis direction. Each second base 10*b* includes a second base body, a plurality of second opening clamping portions 132 and a plurality of second arch bridge portions 182. The second opening clamping portions 132 are disposed on a second long side edge 103 of the second base body. The second arch bridge portions 182 are disposed on the second long side edge 103 of the second base body and are spacingly aligned between the second opening clamping portions 132. Moreover, the second opening clamping portions 132 are engaged with the first opening clamping portions 131 so as to combine the second bases 10*b* with the first bases 10*a*. The loading plates 30 are engaged on the first base 10*a* and aligned between the second bases 10*b* along the second direction. A width W1 of the loading plates 30 along the second direction is larger than a width W2 of the second bases 10*b*. Each loading plate 30 includes a connecting portion 301 abutted against the first base body so as to limit the movement of the loading plate 30 along the first direction. When the loading plates 30 load goods, forks of a forklift are inserted in to the second bases 10*b*, so that the forks of the forklift are abutted against the second arch bridge portions 182 without contacting with the loading plates 30 to lift the goods up.

A thickness T1 of the loading plates 30 along a third direction is smaller than a thickness T2 of the second arch bridge portions 182. The third direction is perpendicular to the first direction and the second direction. Here, the third direction is the Z-axis direction.

The first base 10*a* approximately is a bar-typed rectangular sheet body structure, and may preferably be made from PE, PP or plastic synthetic material. The first base 10*a* has the basic portion 11, where the basic portion 11 has a plurality of first opening clamping portions 131 arranged intervally. In the present embodiment, the number of the first opening clamping portions 131 preferably is 3, but the present invention is not limited to this number; the number of the first opening clamping portions 13 may be increased or decreased depending on a user's need. The shape of the first opening clamping portion 131 and the second opening clamping portion 132 aims at allowing the first bases 10*a* and the second bases 12*b* to engage with each other opening-to-opening, the outlook thereof approximately is rectangular, and the inside thereof is disposed with an opening so the opening-to-opening rectangles can clamp each other. Furthermore, a first slide-in slot 13*a* may additionally be disposed inside the first opening clamping portion 131 and a second slide-in slot 13*b* may additionally be disposed inside the second opening clamping portion 132, allowing the second opening clamping portion 132 to be coupled to the first slide-in slot 13*a* via the second slide-in slot 13*b* so as to connect the first bases with the second bases.

The first slide-in slot 13*a* or the second slide-in slot 13*b* may include a triangular slip slot, but the present invention is not limited to this.

Figure 5:
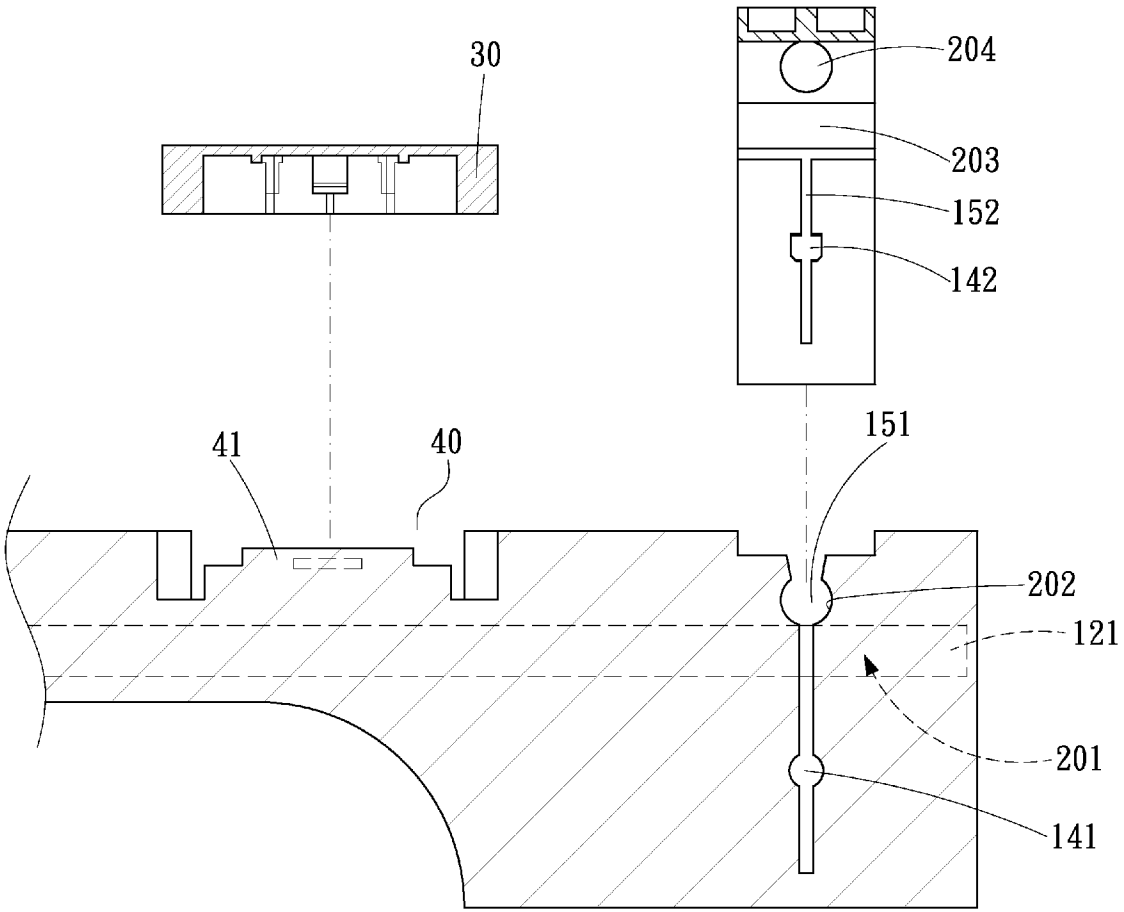
FIG. 5 is an exploded view of a horizontal base, a vertical base and a plastic corner plate of the present invention.
Figure 6:
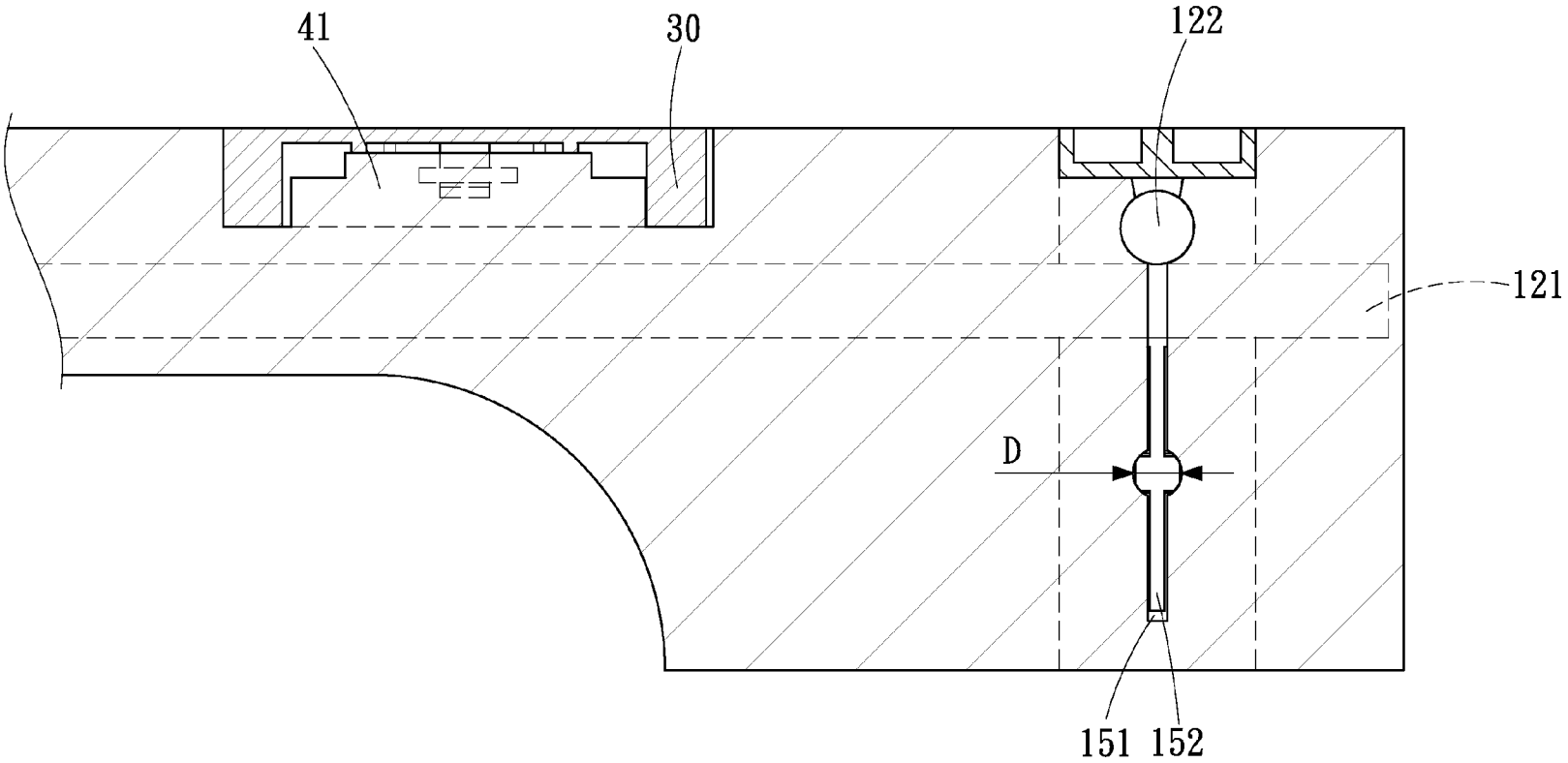
FIG. 6 is a cross section view of the combination of a horizontal base, a vertical base and a plastic corner plate of the present invention.

As shown in FIGS. 5-6, to increase the coupling strength, a first cut line 151 may further be disposed in the first slide-in slot 13*a* with a buckling element 141 being preset in the rear end of the first cut line 151; the buckling element 141 preferably is a circular lock (fastening button). And, a second cut line 152 may further be disposed in the second slide-in slot 13*b* with a fastening component 142 being preset in the rear end of the second cut line 152; the fastening component 142 preferably is a polygonal structure. In order to allow the first opening clamping portion 131 to be slipped into a corresponding second opening clamping portion 132 smoothly while the two bases (the first bases 10*a* and the second bases 10*b*) are coupled together. The first bases 10*a* and the second bases 10*b* can subsequently be coupled to each other tightly due to the automatic fastening of the buckling elements 141 and the fastening component 142. Furthermore, since the first cut line 151 is disposed on the first slide-in slot 13*a* and the second cut line 152 is disposed on the second slide-in slot 13*b* in advance, the first base 10*a* and the second base 10*b* have elasticity due to a gap D such that the first bases 10*a* and the second bases 10*b* with the two different directions can be separated conveniently afterwards, thereby attaining the objects of replacing damaged parts and repeated pallet assembly, as a result of the simple detachment. That is to say, when the first opening clamping portions 131 are combined with the second opening clamping portions 132, the first cut line 151 of the first base 10*a* is almost overlapped with the second cut line 152 of the second base 10*b*, and the gap D is formed after combining the first slide-in slot 13*a* with the second slide-in slot 13*b*, so that the first opening clamping portions 131 of the first bases 10*a* and the second opening clamping portions 132 of the second bases 10*b* have elasticity so as to release the compressive stress. Therefore, when the plastic pallet structure lifts up goods via the loading plates 30, the forces applying to the supporting base are dispersed uniformly, so that the first bases 10*a* and the second bases 10*b* do not easily release from the plastic pallet structure; when the supporting base has to be detached from the plastic pallet structure, the elastic characteristic of the first opening clamping portions 131 and the second opening clamping portions 132 leads the user to detach the supporting base from the plastic pallet structure easily without damaging the first bases 10*a* and the second bases 10*b*.

Additionally, the arch bridge portions 18 (the first arch bridge portions 181 or the second arch bridge portions 182) contracted into a bow shape are disposed in the basic portion 11, and each of them is formed between the two adjacent extension portions 17, thereby allowing the forks of a forklift to be inserted in the plastic pallet conveniently in a horizontal or vertical direction. In addition, the intersection of the two bases (the first bases 10*a* and the second bases 10*b*) forms a cross, providing a solid weight-carrying base.

In the present embodiment, the first supporting portion 16 and the second supporting portion 16*a* are respectively formed to a mesh-typed structure body; upper, lower, left, right three-dimensional supporting groups are formed by coupling them to each section of the first base 10*a* and the second base 10*b* by means of X, Y, E, M, trapezoid, rectangle structures and a group of the combination thereof so as to form a steel-structured structure body capable of carrying a heavy weight, allowing the plastic pallet to be lightweight and still have a good bearing capacity, and allowing a damaged base to be detached easily for replacement, while the plastic pallet maintains its original functions instead of discarding the entire, thereby enabling environmental protection by saving material and reducing waste.

Furthermore, to reduce the space between the first base 10*a* and the second base 10*b* and prevent a small carried article from falling through a vacancy, loading plates 30 may be provided. Here, the loading plates 30 can be plastic corner plates which are hollow and made from a mesh coupling through plastic extrusion. The plastic corner plates 30 are assembled to the plastic pallet structure via an embedded method. But embodiments of the present invention are not limited thereto. The material of the loading plates 30 is adjustable according to the practical situations. A buckling structure 31 may respectively be disposed on the intersections with the first base 10*a*, allowing the plastic corner plate 30 to be buckled into the first base 10*a* conveniently and quickly. Furthermore, bow-typed extensions made of a mesh-typed sheet body are disposed on the plastic corner plate 30 and coupled to the first base 10*a*; it can further strengthen the compressive stress of the plastic corner plate 30.

In this embodiment, the first base body includes a plurality of engaging grooves 40 provided for engaging with the plastic corner plates 30. As shown in FIG. 2, the engaging grooves 40 are formed corresponding to the three dimensional mesh-typed structure body of a first base 10*a*, and the shape of the connecting portion 301 fits the shape of the engaging groove 40. Therefore, the connecting portions 301 of the plastic corner plates 30 are engaged with the recessed portions 401 of the engaging grooves 40 via the protruded portions 3011 so as to limit the movement of the plastic corner plates 30 along the first direction. But embodiments of the present invention are not limited thereto; in one implementation aspect, the connecting portions 301 of the plastic corner plates 30 are engaged with the protruded portions of the engaging grooves 40 via the recessed portions so as to limit the movement of the plastic corner plates 30 along the first direction.

The number of the first bases 10*a* and that of the second bases 10*b* in the present embodiment depend on the weight carried by the pallet. The pallet may be included of two first bases 10*a* and two second bases 10*b*, three first bases 10*a* and three second bases 10*b* or four first bases 10*a* and four second bases 10*b*, collocating with the plastic corner plate 30 positioned on each first base 10*a* or second base 10*b*. The number of first bases 10*a* and that of the second bases 10*b* mentioned above are exemplary and explanatory only, the present invention is not limited to these.

That is to say, in some implementation aspects, the number of the first bases 10*a* and that of the second bases 10*b* is two, and the number of the first opening clamping portions 131 of each first base 10*a* and that of the second opening clamping portions 132 of each second base 10*b* is two, while the number of the loading plates 30 is one. At this time, the width W1 of the plastic corner plate 30 and that of the engaging groove 40 are slightly smaller than the first base body; namely, the loading plate 30 for carrying goods is placed within a region enclosed by the first bases 10*a* and the second bases 10*b*. Therefore, the number of the first bases 10*a*, the number of the second bases 10*b*, the number of the first opening clamping portions 131, the number of the second opening clamping portions 132, the width and the number of the engaging grooves 40 and the width and the number of the loading plates 30 are cooperated with the combination type of the above elements and are all adjustable according to the practical situations.

Figure 3:
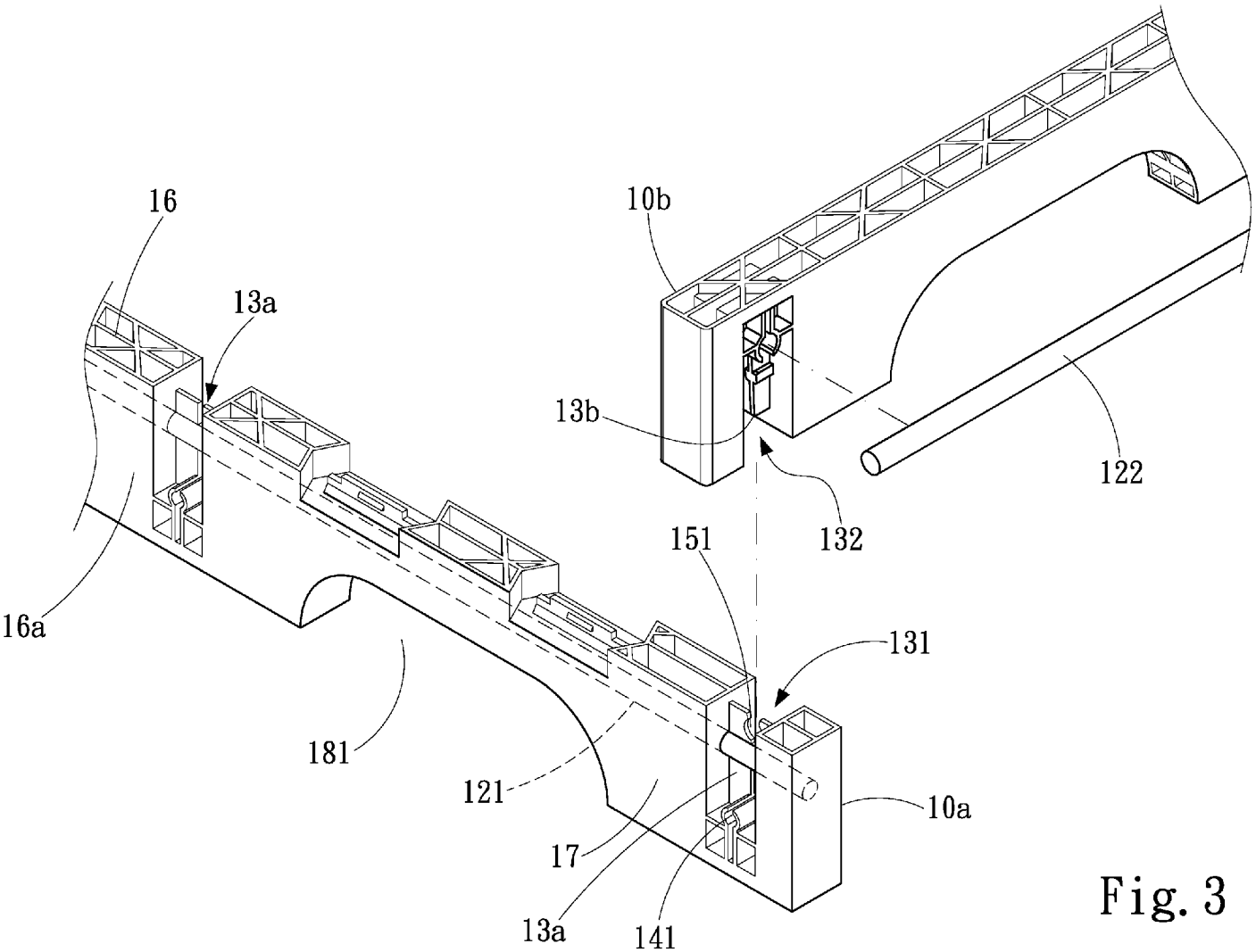
FIG. 3 is an exploded view of a horizontal base and a vertical base of the present invention.

Please refer to FIG. 3, which is a detachable plastic pallet structure with beam columns 12 of a second preferred embodiment according to the present invention. To strengthen the bearing capacity of the plastic pallet, the present invention proposes especially a detachable plastic pallet with structure beam columns 12. The beam column 12 approximately is a bar-typed circular column; it is preferably made from metal, such as iron, aluminum alloy, but the present invention is not limited to these. The disposition method thereof has the following steps: first, forming the first bases 10*a* and the second bases 10*b* from plastics by means of pressure casting in advance depending on a structure requirement. The first base 10*a* (the horizontal base) mainly includes a basic portion 11, a plurality of first opening clamping portions 131, a plurality of extension portions 17, a plurality of first arch bridge portions 181, and the sheet body made from plastics by means of pressure casting is used to couple to the main portions by means of steel beam connected mesh-typed structure body so as to form the mesh-typed structure body as a support. The area of the upper layer of the mesh-typed structure sheet body, i.e. the basic portion 11 is called as a first supporting portion 16. And the area of the lower layer thereof, i.e. the extension portion 17 is called as a second supporting portion 16*a*.

The second base 10*b* (the vertical base) also mainly includes a basic portion 11, a plurality of second opening clamping portions 132, a plurality of extension portions 17, a plurality of second arch bridge portions 182; the reason that it is defined as the vertical base is because the opening of the second opening clamping portion 132 faces downward. Similarly, a sheet body made from plastics by means of pressure casting is formed into a mesh-typed structure of sheet body by means of the steel structure of the connection of steel beams in architecture through plastic pressure casting; the sheet body is used as a basis to couple to each portion, forming the first supporting portion 16 and the second supporting portion 16*a* of the second base 10*b*.

That is to say, both the first base 10*a* and the second base 10*b* have the first supporting portion 16 and the second supporting portion 16*a*.

Furthermore, the beam column 12 is installed in advance; the beam column 12 is used for increasing a bearing capacity of the first base 10 (or the second base 10*b*) after being combined therewith; the beam column 12 is installed extraordinarily at the set positions of the first opening clamping portions 131 of the first base 10*a* (or the second opening clamping portions 132 of the second base 10*b*) as FIG. 3 shows, thereby forming a plastic pallet with the crisscross beam columns 12 hereafter called as the first beam column 121 and the second beam column 122) after the first bases 10*a* and the second bases 10*b* are coupled together. As a result, the weight and pressure resisting capabilities of the pallet of the present invention can be increased.

To elucidate in a detailed manner, the first opening clamping portion 131 has a first accepting space 201 and a second accepting space 202. The first accepting space 201 is provided for receiving the first beam column 121 of the first base 10*a* penetrated therethrough. The second accepting space 202 is provided for receiving the second beam column 122 engaged by the second opening clamping portion 132. Moreover, the second opening clamping portion 132 has a third accepting space 203 and a fourth accepting space 204. The third accepting space 203 is provided for receiving the first beam column 121 engaged by the first opening clamping portion 131. The fourth accepting space 204 is provided for receiving the second beam column 122 of the second base 10*b* penetrated therethrough. The first beam column 121 of the first bases 10*a* is a first plane, and the second beam column 122 of the second bases 10*b* is a second plane paralleled to the first plane, so that the first plane and the second plane are provided as the basis for the combining of the first bases 10*a* and the second bases 10*b* so as to strength the bearing capacity.

A method for installing the beam column 12 in advance includes an integral forming: in the first bases 10*a* and the second bases 10*b*, pre-making the beam column 12 and pre-planning the connection between the beam column 12 and the sheet body of the first supporting portion 16 while installing the sheets (the first supporting portion 16 and the second supporting portion 16*a*), coupled to each main site, and an integration is completed after pressure-casting plastics by means of taking the beam column 12 as a center to form a united body including such features as X, Y, V and H structures, forming the first bases 10*a* and the second bases 10*b* (horizontal or vertical detachable bases) with the beam column 12 used for forming a steel type of structure body capable of bearing a heavy weight.

The installment method further includes a space reservation method: pre-measuring and pre-positioning an accepting space 201204 for placing a metal material on every site of the first bases 10*a* and the second bases while the sheet body of the first supporting portion 16 is connected as FIGS. 3, 5 and 6 show, allowing the placement position to be completed after the first base 10*a* and the second base 10*b* are integrated into one body. At this time, a metal bar with a required diameter may be inserted from the outside depending on requirements. Furthermore, an engagement lock (not shown in the figures), may also remain since a position is reserved in advance, allowing the placed-in bar to be retained after the first bases 10*a* and the second bases 10*b* are connected tightly to each other. If there is a need for the beam column 12 to be taken out, the engagement lock can simply be opened, and the beam removed.

The first bases 10*a* with the first beam column 121 and the second bases 10*b* with the second beam column 122 are both coupled to each other by engaging the first opening clamping portions 131 and the second opening clamping portions 132 with each other, as FIG. 3 shows. The multiple first bases 10*a* and second bases 10*b* are coupled together to constitute an independent pallet as FIG. 1 shows. The present invention also provides the plastic corner plate 30, to reduce a distance between the two adjacent first bases 10*a* (or the two adjacent second bases 10*b*).

Figure 4:
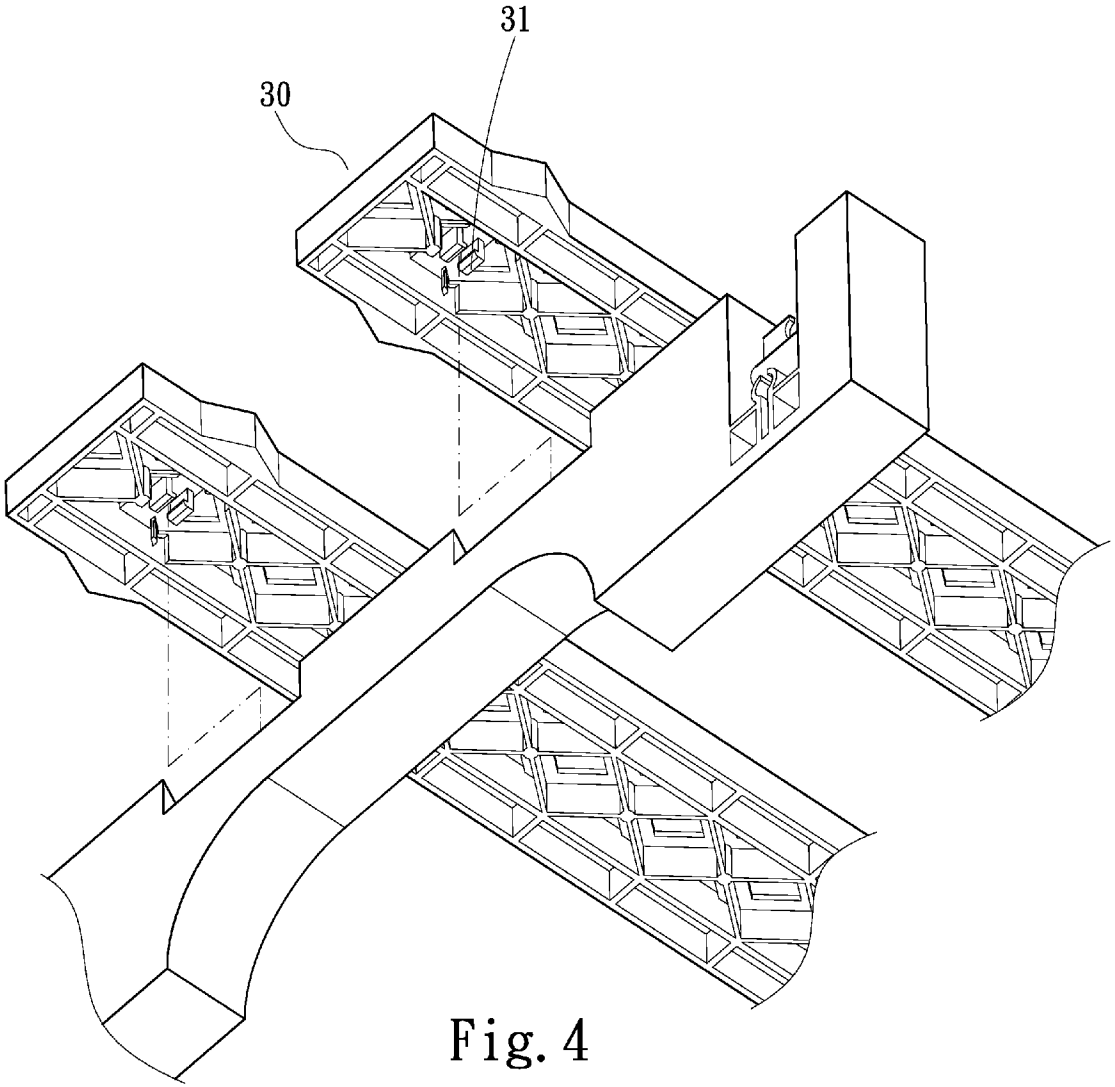
FIG. 4 is an exploded view of a horizontal base and plastic corner plate of the present invention.

Please refer to FIGS. 3 and 4, in which the plastic corner plate 30 is includes coupling the plastic mesh-typed structures together, and the buckling structure 31 is respectively disposed on a contact position of the first base 10*a* and a contact position of the plastic corner plate 30 corresponding thereto. The buckling structure 31 may preferably be a upper, lower composite active lock, a stackable button, a circular button or a hook clipper, used to couple the plastic corner plate 30 to the first base 10*a*. Furthermore, every basic portion 11 of the first base 10*a* has a plurality of engaging grooves 40, used for positioning the corresponding plastic plate 30. In view of this, the engaging groove 40 has a coupling element 41, used to couple the plastic corner plate 30 thereto, thereby allowing the plastic corner plate 30 to be coupled to the first base 10*a* (or the second base 10*b*) more tightly. If the corner plate 30 needs to be detached from the first bases 10*a* (or the second bases 10*b*), the coupling elements 41, which are tightly coupled to the plastic corner plate 30, may be released by way of pressing or swaying, and the plastic corner plate 30 can then be detached downwards.

The beam column 12 of the present invention can increase the structural strength of the first bases 10*a* and that of the second bases 10*b*. The interlacing supporting portions formed through the hollow space in the seat bodies of the first bases 10*a* and the second bases 10*b* further increase the structural strength in the horizontal and vertical directions, thereby increasing the torque and diagonal shear, solving the problem of a conventional pallet in which a dynamic load cannot be carried, causing pallet breakage or damage to the buckling element used for the assembly.

The first beam column 121 and the first opening clamping portions 131 of the first bases 10*a*, and the second beam column 122 and the second opening clamping 132 of second bases 10*b* are used to form the first bases 10*a* and the second bases 10*b* into a crisscross combination, thereby increasing the compressive torque and shear of the pallet. However, for lightweight transportation, the beam column 12 may be omitted since the dynamic load of a heavy weight is unnecessary, though the first opening clamping portions 131 (or the second opening clamping portions 132) of each main body are still maintained. Furthermore, even the six or eight piece type combination is unnecessary; the four piece type combination with the plastic corner plates 30 is sufficient. The four pieces type combination is formed by crisscrossing, pressing and clamping the two first bases 10*a* with the two second bases 10*b* so as to form a slotted shape, thereby achieving the objects of a flexible combination and saving material.

While the present invention has been described by the way of example and in terms of the preferred embodiments, it is to be understood that the invention need not to be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A plastic pallet structure, comprising:

a supporting base, comprising:

a plurality of first bases, aligned along a first direction, each first base comprising a first base body, a plurality of first opening clamping portions and a plurality of first arch bridge portions, the first opening clamping portions being disposed on a first long side edge of the first base body, the first arch bridge portions being disposed on another first long side edge of the first base body and spacingly aligned between the first opening clamping portions;

a plurality of second bases, aligned along a second direction, each second base comprising a second base body, a plurality of second opening clamping portions and a plurality of second arch bridge portions, the second opening clamping portions being disposed at a second long side edge of the second base body, the second arch bridge portions being disposed on the second long side edge of the second base body and spacingly aligned between the second opening clamping portions, the second opening clamping portions engaged with the first opening clamping portions so as to combine the second bases with the first bases; and a plurality of loading plates, each including:

a plate body, engaged on the first bases and aligned between the second bases along the second direction, a width of the plate body along the second direction being larger than a width of the second bases along the second direction; and a connecting portion, the connecting portion engaged with the first base body according to a shape of the connecting portion which is correspondingly fit to the first base body, and a width of the connecting portion along the second direction different from the width of the plate body, so as to limit movement of the loading plate along the first direction, and a thickness of the loading plates along a third direction is smaller than a thickness of the second arch bridge portions along the third direction, wherein the third direction is perpendicular to the first direction and the second direction, when the loading plates support goods, forks of a forklift are inserted into the second bases, so that the forks of the forklift are abutted against the second arch bridge portions without contacting with the loading plates to lift the goods up;

wherein each first base body comprises a plurality of engaging grooves provided for engaging with the connecting portion; and wherein the connecting portion is engaged with a recessed portion of the engaging groove via a protruded portion having a width in the second direction greater than the width of the plate body in the second direction, so as to limit the movement of the loading plate along the first direction.

2. The plastic pallet structure according to claim 1, wherein the connecting portion is further engaged with a protruded portion of the engaging groove via a recessed portion so as to limit the movement of the loading plate along the second direction.

3. The plastic pallet structure according to claim 1, wherein the first bases have a three dimensional mesh-typed structure body comprising a structure selected from the group consisting of X-typed, E-typed, Y-typed, M-typed, rectangle-typed structures and a group of the combination thereof, so as to form a steel-structured structure body capable of carrying a heavy weight, the engaging grooves are formed corresponding to the three dimensional mesh-typed structure body, and the shape of the connecting portion fits the shape of the engaging groove.

4. The plastic pallet structure according to claim 1, wherein the connecting portion comprises a buckling structure disposed corresponding to the first base body, the first base body and the buckling structure of the connecting portion are correspondingly formed as a composite lock, a stackable button, a circular button or a hook clipper.

5. The plastic pallet structure according to claim 1, wherein the loading plates are constituted using plastic sheet bodies by means of mesh type coupling so as to strengthen the compressive stress of the loading plates.

6. The plastic pallet structure according to claim 1, wherein each first opening clamping portion comprises:

a first accepting space, provided for receiving a first beam column of the first base penetrated therethrough;

a second accepting space, provided for receiving a second beam column engaged by the second opening clamping portion; and a first slide-in slot, comprising a first cut line and a fastening button.

7. The plastic pallet structure according to claim 6, wherein each second opening clamping portion comprises:

a third accepting space, provided for receiving the first beam column engaged by the first opening clamping portion;

a fourth accepting space, provided for receiving the second beam column of the second base penetrated therethrough; and a second slide-in slot, comprising a second cut line and a fastening component, the second opening clamping portion is engaged with the first opening clamping portion and the fastening button is sleevingly locked with the fastening component, wherein the first cut line is almost overlapped with the second cut line, a gap is kept after the first slide-in slot with the second slide-in slot are combined, so that the first opening clamping portions of the first bases and the second opening clamping portions of the second bases have elasticity so as to release the compressive stress.

8. The plastic pallet structure according to claim 7, wherein the first beam column of the first bases defines a first plane, and the second beam column of the second bases defines a second plane paralleled to the first plane, so that the first plane and the second plane are provided as the basis for the combining of the first bases and the second bases so as to strengthen the bearing capacity.

9. The plastic pallet structure according to claim 7, wherein the first beam column and the second beam column are made of metal.

10. The plastic pallet structure according to claim 1, wherein each first base and each second base comprise a first supporting portion and a second supporting portion, the first supporting portion and the second supporting portion are alternatively disposed on an interior of the first base body and an interior of the second base body along the third direction so as to form a hollow space to enhance the horizontal strength and the vertical strength and increase the torque and diagonal shear.

11. The plastic pallet structure according to claim 1, wherein a complete base is formed by means of plastic pre-casting and coupling a mesh-typed sheet body to every section of the first bases and the second bases; when the first bases and the second bases are combined, an assembling type plastic pallet capable of carrying a heavy weight is formed.

* * * * *

UNITED STATES PATENT AND TRADEMARK OFFICE

CERTIFICATE OF CORRECTION

PATENT NO. : 8,833,270 B2
APPLICATION NO. : 13/903792
DATED : September 16, 2014
INVENTOR(S) : Jian It is certified that error appears in the above-identified patent and that said Letters Patent is hereby corrected as shown below:

On the title page, insert item --[71] Applicants: AIR-BAG PACKING CO., LTD.,
New Taipei City (TW)
LIAO, YAW-SHIN
New Taipei City (TW)-- item --[73] Assignees: AIR-BAG PACKING CO., LTD.,
New Taipei City (TW)
LIAO, YAW-SHIN
New Taipei City (TW)--

Signed and Sealed this
Thirtieth Day of June, 2015

Michelle K. Lee

Michelle K. Lee
*Director of the United States Patent and Trademark Office*